US006722524B1

(12) United States Patent
Huang et al.

(10) Patent No.: US 6,722,524 B1
(45) Date of Patent: Apr. 20, 2004

(54) TOOL BOX WITH EASILY MOUNTABLE HANDLE

(75) Inventors: Steve Huang, Taichung Hsien (TW); Wesley Lee, Taichung Hsien (TW)

(73) Assignee: Stanley Chiro International Ltd. (TW)

( * ) Notice: Subject to any disclaimer, the term of this patent is extended or adjusted under 35 U.S.C. 154(b) by 0 days.

(21) Appl. No.: 10/327,019

(22) Filed: Dec. 19, 2002

(51) Int. Cl.[7] ..... B65D 25/28
(52) U.S. Cl. ..... 220/761; 220/775; 220/776
(58) Field of Search ..... 220/752, 759, 220/761, 775, 776; 16/DIG. 24

(56) References Cited

U.S. PATENT DOCUMENTS 3,153,491 A * 10/1964 MacTavish et al. ..... 220/770
3,940,013 A * 2/1976 Bonnett ..... 220/751
4,157,763 A * 6/1979 Betlejewski et al. ..... 220/761
4,632,888 A * 12/1986 Kump et al. ..... 429/187
4,987,639 A * 1/1991 Baiuley et al. ..... 16/445
6,152,317 A * 11/2000 Newby, Sr. ..... 220/4.22

* cited by examiner

*Primary Examiner*—Joseph M. Moy
(74) *Attorney, Agent, or Firm*—Ostrolenk, Faber, Gerb & Soffen, LLP

(57) ABSTRACT

A tool box is formed with two counter bores, and includes a handle formed with headed latches. Each of the counter bores has an upper enlarged section and a lower constricted section confined by an inward flange. Each of the headed latches includes an enlarged head received in the enlarged section of the respective counter bore, and a bifurcated shank having a pair of elastic legs that are respectively formed with barbed ends, and extending through the constricted section of the respective counter bore such that the flange is sandwiched between the enlarged head and the barbed ends of the elastic legs.

2 Claims, 7 Drawing Sheets

TOOL BOX WITH EASILY MOUNTABLE HANDLE

BACKGROUND OF THE INVENTION

1. Field of the Invention

The present invention relates to a tool box, more particularly to a tool box that includes a box body and a handle which can be attached to the box body with ease.

2. Description of the Related Art

Referring to FIG. 1, a conventional tool box is shown to include a box body having pivotally connected upper and lower box parts 1, 2, and a handle 3.

The upper box part 1 is formed with a pair of spaced apart handle-mounting seats 101 having opposite end faces formed with mounting holes 102 respectively. The handle 3 includes a generally U-shaped handgrip portion 301 and two insert ends 302 extending into the mounting holes 102 in the handle-mounting seats 101.

Since a relatively large force is required to slightly bend the handle 3 inwardly so as to permit entry of the handle 3 into a space between the mounting holes 102, it is relatively inconvenient to insert the insert ends 302 of the handle 30 into the mounting holes 102 in the handle-mounting seats 101.

SUMMARY OF THE INVENTION

The object of the present invention is to provide a tool box that includes a box body formed with spaced apart handle-mounting seats, and a handle formed with two headed latches that can be easily inserted into counter bores formed in the handle-mounting seats so as to avoid the occurrence of the aforesaid drawback encountered during mounting of the handle to the box body of the conventional tool box.

Accordingly, a tool box of the present invention includes an upper box part, a lower box part, and a handle. The lower box part is pivotally connected to the upper box part, and has a front wall, and two spaced apart handle-mounting seats protruding from the front wall. Each of the handle-mounting seats is formed with a counter bore that has an upper enlarged section, and a lower constricted section reduced from the enlarged section, and has an inward flange confining the constricted section. The handle has two opposite ends, and two headed latches that are respectively formed on the opposite ends of the handle. Each of the headed latches includes an enlarged head, and a bifurcated shank which is reduced from the enlarged head and which includes a pair of elastic legs with barbed ends. The headed latches are fittingly and respectively inserted into the counter bores in the handle-mounting seats in such a manner that the enlarged head of each of the headed latches is received in the enlarged section of a respective one of the counter bores, that the elastic legs extend through the constricted section of the respective one of the counter bores, and that the flange of each of the handle-mounting seats is sandwiched between and abuts against the enlarged head and the barbed ends of the elastic legs of the bifurcated shank of the respective one of the headed latches, thereby preventing removal of the handle from the lower box part.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
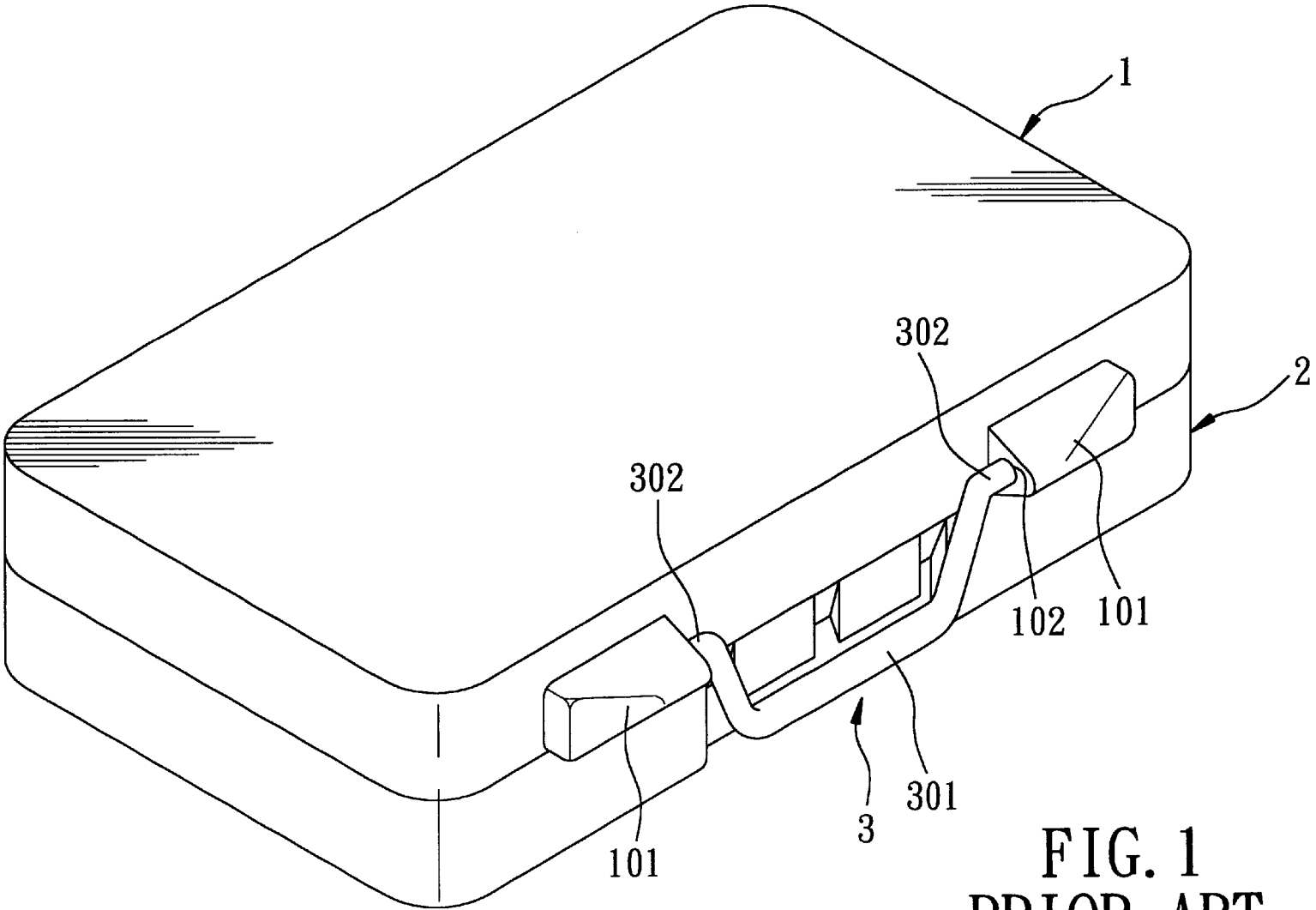
FIG. 1 PRIOR ART
FIG. 1 is a perspective view of a conventional tool box.
Figure 2:
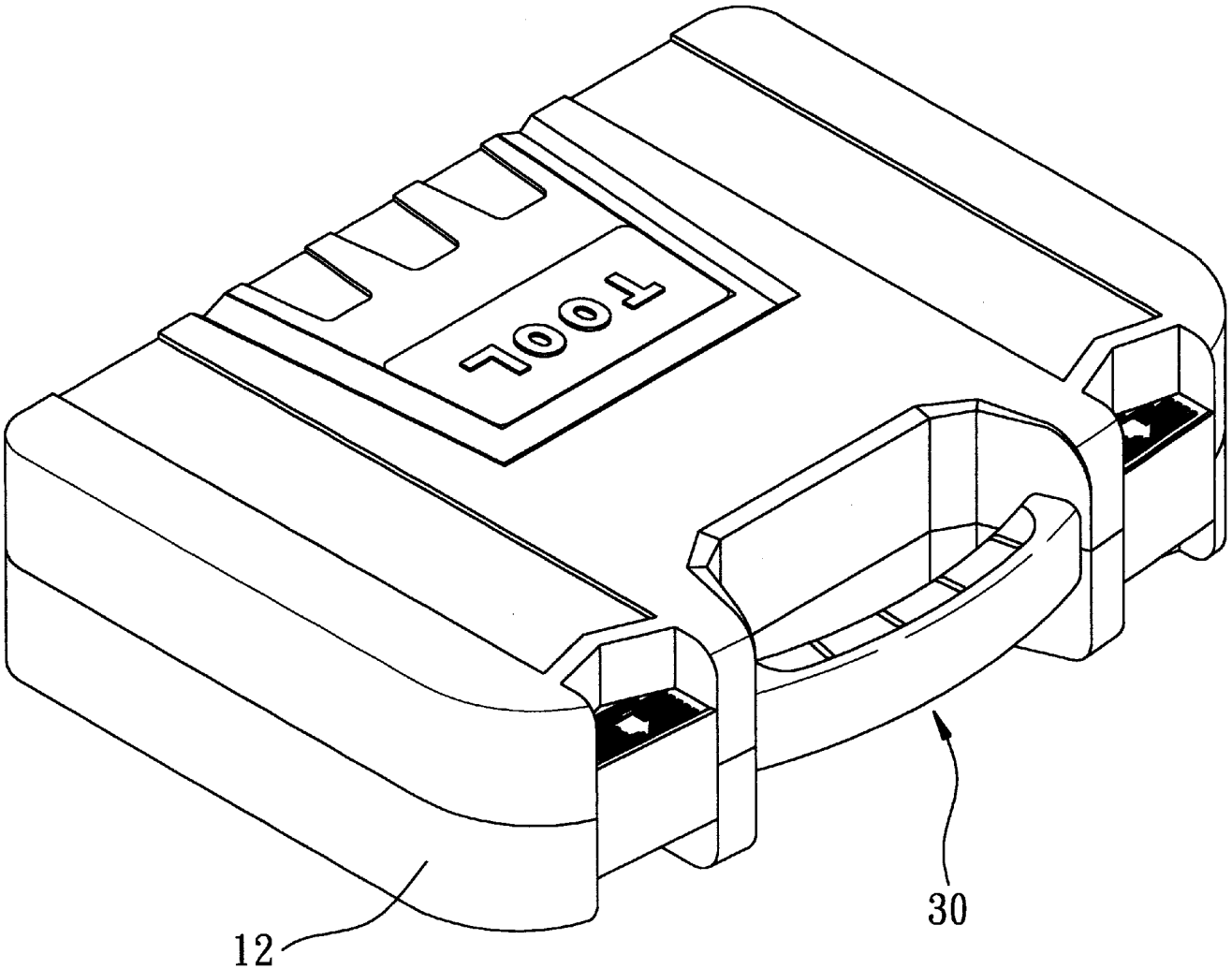
FIG. 2 is a perspective view of the preferred embodiment of a tool box according to the present invention.
Figure 3:
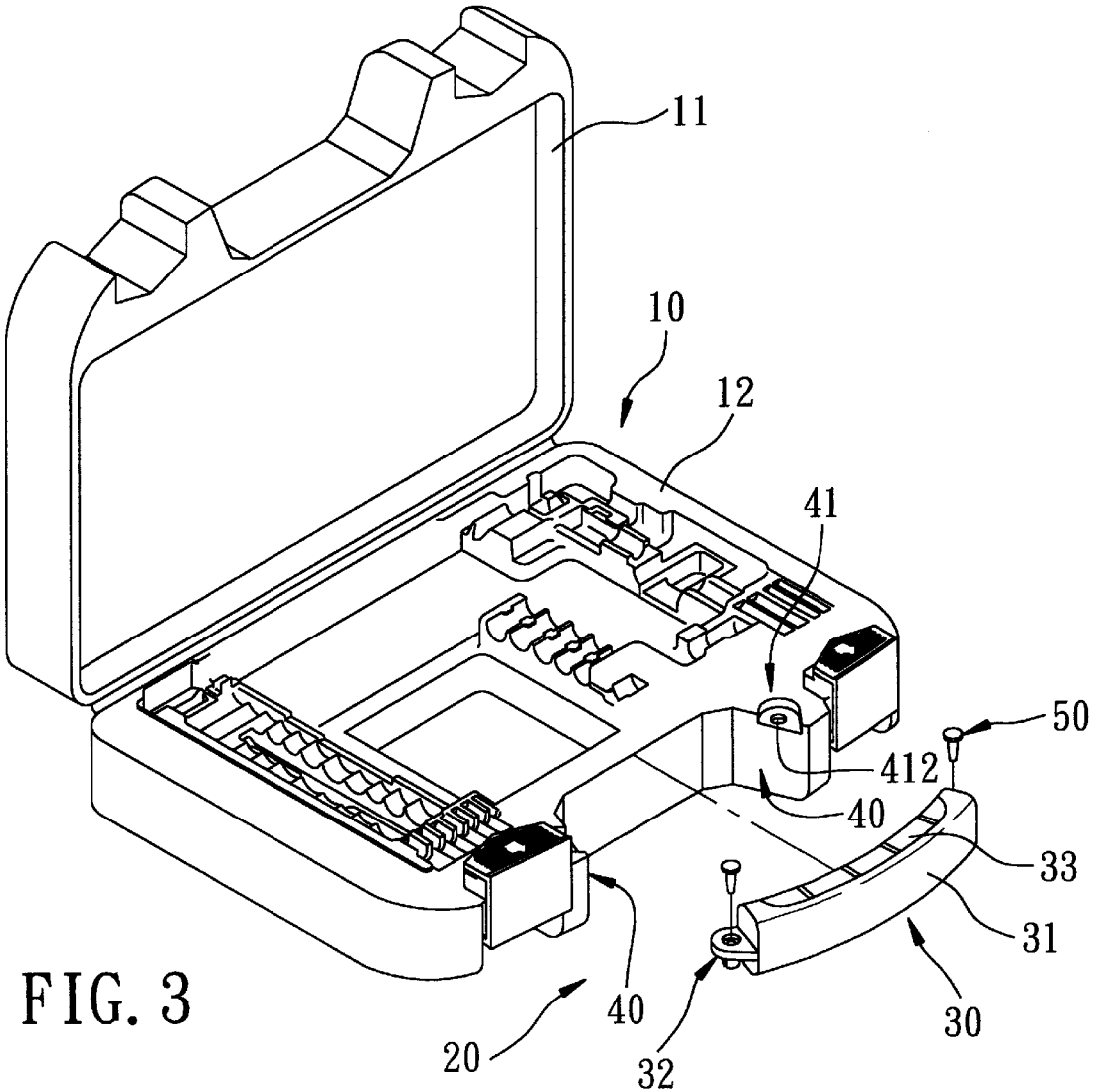
FIG. 3 is a perspective view of the preferred embodiment, with a handle removed therefrom.
Figure 4:
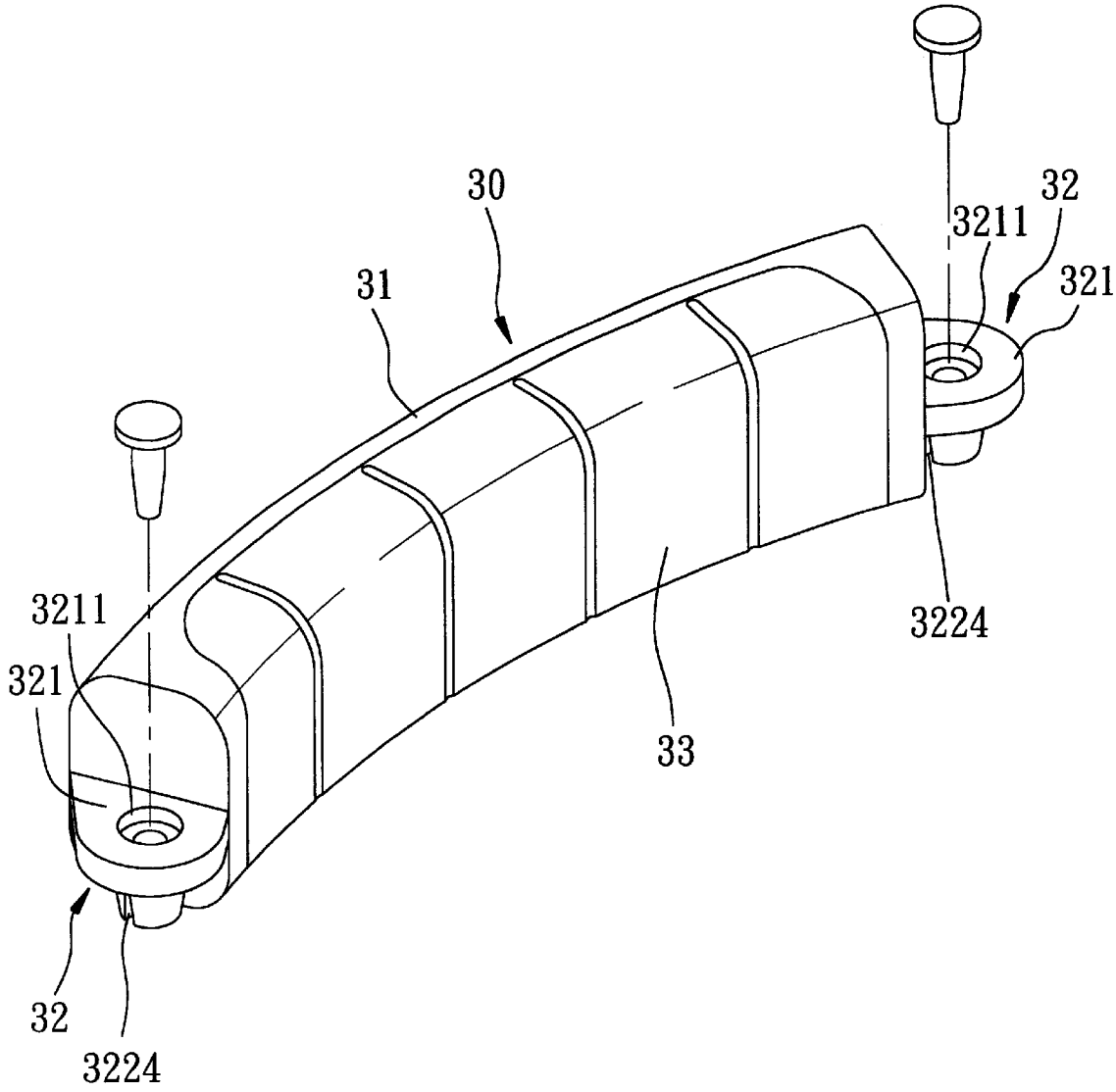
FIG. 4 is a perspective enlarged view of the handle shown in FIG. 3.
Figure 5:
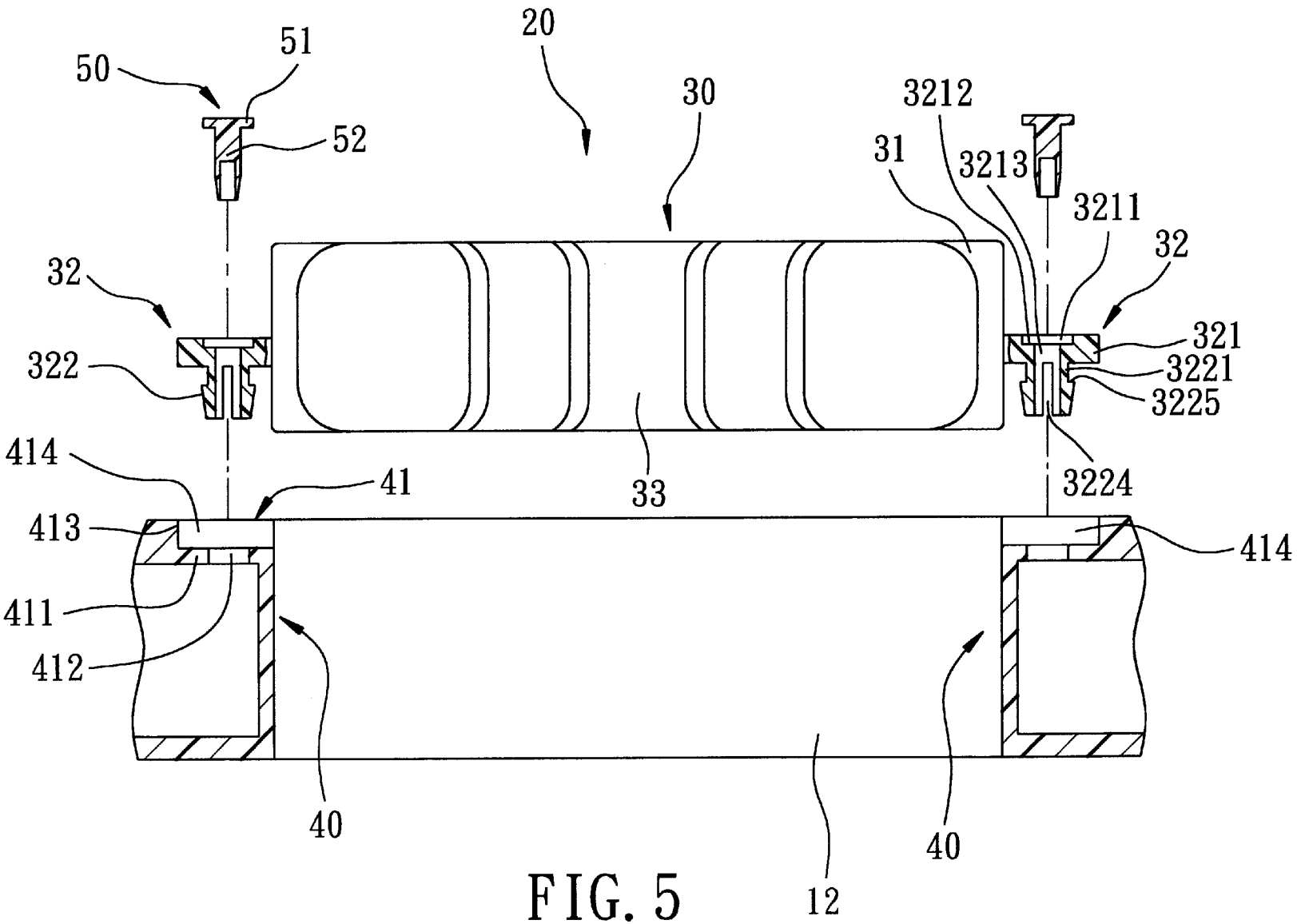
FIG. 5 is a fragmentary sectional view shown in a state prior to fitting of the handle into a lower box part of the preferred embodiment during assembly.

Referring to FIGS. 2 to 5, the preferred embodiment of a tool box 10 according to the present invention is shown to include an upper box part 11, a lower box part 12, and a handle 30.

As illustrated, the lower box part 12 is pivotally connected to the upper box part 11, and has a front wall 40, and two spaced apart handle-mounting seats 41 protruding from the front wall 40. Each of the handle-mounting seats 41 is formed with a first counter bore 414 that has an upper enlarged section 413, and a lower constricted section 412 that is reduced from the enlarged section 413. Each of the handle-mounting seats 41 has an inward flange 411 confining the constricted section 412.

Figure 6:
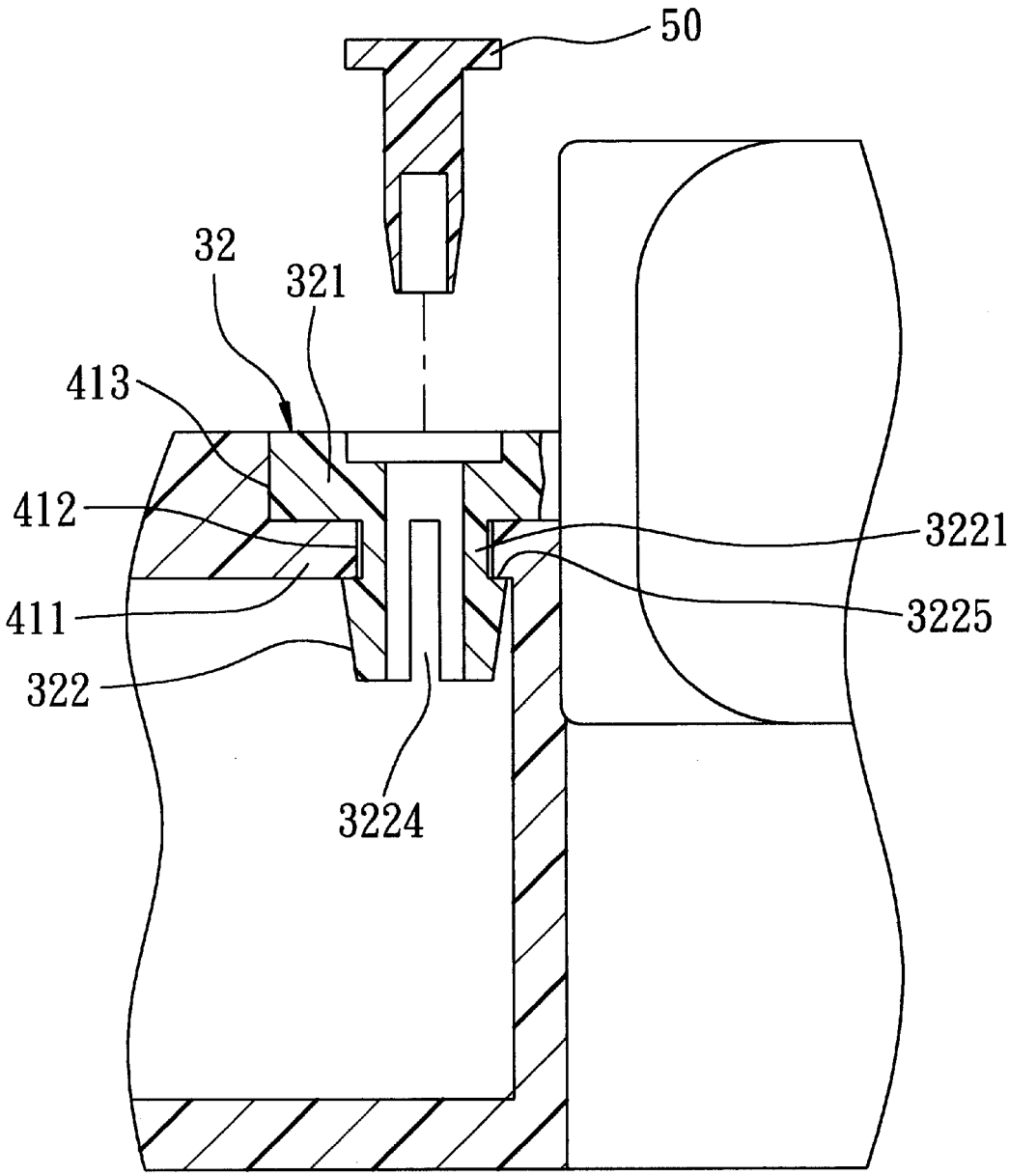
FIG. 6 is a fragmentary sectional view of the preferred embodiment shown in a state prior to fitting of a locking bolt within a counter bore in the handle during assembly.

The handle 30 is mounted on the lower box part 12, and includes an elongated handgrip portion 31 having two opposite ends, and two headed latches 32 that are respectively formed on the opposite ends of the handgrip portion 31. A felt strip 33 is preferably attached to a rear side of the handgrip portion 31 to facilitate gripping of the handgrip portion 31. Each of the headed latches 32 includes an enlarged head 321, and a bifurcated shank 322. The bifurcated shank 322 is reduced from the enlarged head 321, and includes a pair of elastic legs 3221 with barbed ends 3225. The headed latches 32 are fittingly and respectively inserted into the first counter bores 414 in the handle-mounting seats 41 in such a manner that the enlarged head 321 of each of the headed latches 32 is received in the enlarged section 413 of a respective one of the first counter bores 414, that the elastic legs 3221 extend through the constricted section 412 of the respective one of the first counter bores 414, and that the flange 411 of each of the handle-mounting seats 41 is sandwiched between and abuts against the enlarged head 321 and the barbed ends 3225 of the elastic legs 3221 of the bifurcated shank 322 of the respective one of the headed latches 32, thereby preventing removal of the handle 30 from the lower box part 12 (see FIG. 6).

In this embodiment, the elastic legs 3221 of the bifurcated shank 322 of each of the headed latches 32 define a gap 3224 therebetween. The enlarged head 321 of each of the headed latches 32 defines a second counter bore 3211 that is in spatial communication with the gap 3224 and that has an upper enlarged section 3212 and a lower constricted section 3213 reduced from the enlarged section 3212 of the second counter bore 3211.

Figure 7:
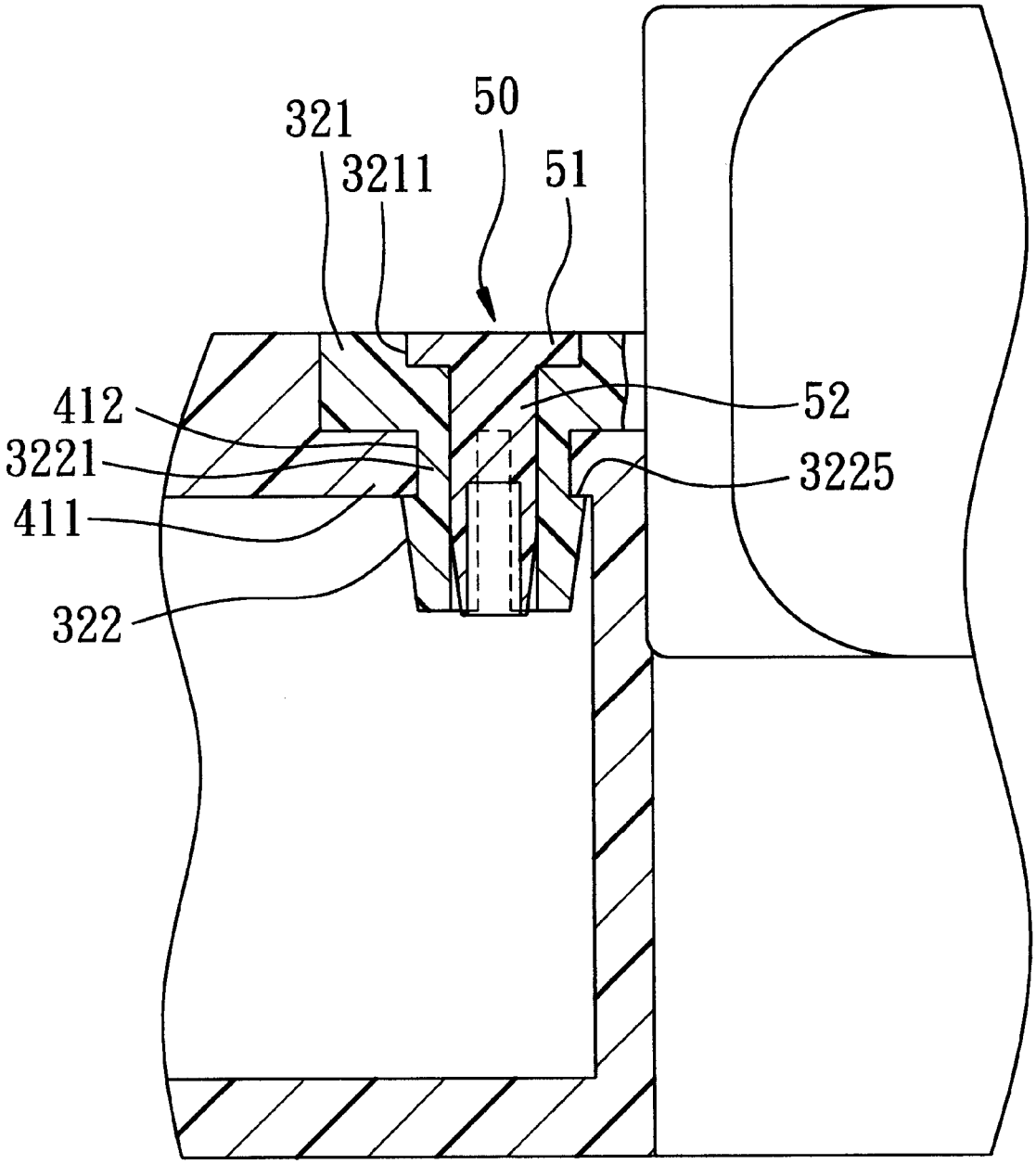
FIG. 7 is a fragmentary sectional view of the preferred embodiment, illustrating how the handle is disposed securely within the counter bore in the handle after assembly.

The tool box of the present invention further includes a pair of locking bolts 50. Each of the locking bolts 50 has an enlarged head 51 and a bifurcated cylindrical shank 52 that is reduced from the enlarged head 51 and that is inserted through the second counter bore 3211 in a respective one of the headed latches 32 such that the enlarged head 51 of each of the locking bolts 50 is received in the enlarged section 3212 of the respective one of the second counter bores 3211. The bifurcated cylindrical shank 52 of each of the locking bolts 50 further extends into the gap 3224 between the elastic legs 3221 of the bifurcated shank 322 of the respective one of the headed latches 32 so as to result in radial and outward expansion of the elastic legs 3221, which in turn results in tight sandwiching of the flange 411 of the respective handle-mounting seat 41 between the enlarged head 321 and the barbed ends 3225 of the elastic legs 3221 of the respective one of the headed latches 32, as best shown in FIG. 7, thereby enhancing engagement between the headed latches 32 and the handle-mounting seats 41.

Since the bifurcated shanks 322 of the headed latches 32 can be inserted into the first counter bores 414 in the handle-mounting seats 41 with ease, and since mounting of the locking bolts 50 into the second counter bores 3211 in the enlarged heads 321 of the headed latches 32 can also be conducted in a simple way, the drawback as encountered during assembly of the handle to the box body of the aforesaid conventional tool box can be eliminated.

While the present invention has been described in connection with what is considered the most practical and preferred embodiment, it is understood that the present invention is not limited to the disclosed embodiment but is intended to cover various arrangements included within the spirit and scope of the broadest interpretation so as to encompass all such modifications and equivalent arrangements.

We claim:

1. A tool box comprising:

an upper box part;

a lower box part pivotally connected to said upper box part, and having a front wall, and two spaced apart handle-mounting seats protruding from said front wall, each of said handle-mounting seats being formed with a first counter bore that has an upper enlarged section, and a lower constricted section reduced from said enlarged section, each of said handle-mounting seats having an inward flange confining said constricted section; and a handle mounted on said lower box part, and having two opposite ends and two headed latches that are respectively formed on said opposite ends of said handle, each of said headed latches including an enlarged head, and a bifurcated shank which is reduced from said enlarged head and which includes a pair of elastic legs with barbed ends, said headed latches being fittingly and respectively inserted into said first counter bores in said handle-mounting seats in such a manner that said enlarged head of each of said headed latches is received in said enlarged section of a respective one of said first counter bores, that said elastic legs extend through said constricted section of the respective one of said first counter bores, and that said flange of each of said handle-mounting seats is sandwiched between and abuts against said enlarged head and said barbed ends of said elastic legs of said bifurcated shank of the respective one of said headed latches, thereby preventing removal of said handle from said lower box part.

2. The tool box as defined in claim 1, wherein said elastic legs of said bifurcated shank of each of said headed latches define a gap therebetween, said enlarged head of each of said headed latches defining a second counter bore that is in spatial communication with said gap and that has an upper enlarged section and a lower constricted section reduced from said enlarged section of said second counter bore, said tool box further comprising a pair of locking bolts, each of said locking bolts having an enlarged head and a cylindrical shank that is reduced from said enlarged head of said locking bolt and that is inserted through said second counter bore and into said gap so as to result in radial and outward expansion of said elastic legs, which in turn results in tight sandwiching of said flange of each of said handle-mounting seats between said enlarged head and said barbed ends of said elastic legs of said bifurcated shank of the respective one of said headed latches, thereby enhancing engagement between said headed latches and said handle-mounting seats.

* * * * *